US006752281B1

(12) United States Patent
Mason et al.

(10) Patent No.: US 6,752,281 B1
(45) Date of Patent: Jun. 22, 2004

(54) DISPLAY DEVICE

(75) Inventors: Timothy L. Mason, Melville, NY (US); James D. Hitchens, Islip Terrace, NY (US)

(73) Assignee: New Dimensions Research Corporation, Melville, NY (US)

( * ) Notice: Subject to any disclaimer, the term of this patent is extended or adjusted under 35 U.S.C. 154(b) by 0 days.

(21) Appl. No.: 10/392,597

(22) Filed: Mar. 20, 2003

(51) Int. Cl.[7] ..... A47F 5/00

(52) U.S. Cl. ..... 211/195; 211/163; 211/131.1; 211/133.1; 312/135

(58) Field of Search ..... 211/131.1, 133.1, 211/42, 144, 163, 195; 312/125, 135, 202

(56) References Cited

U.S. PATENT DOCUMENTS 720,190 A * 2/1903 Stoddart
2,344,650 A * 3/1944 Sloat
3,243,047 A * 3/1966 Witteborg
3,485,543 A * 12/1969 Selden et al.
4,548,324 A * 10/1985 Mackey, Jr. ..... 211/163 X
4,673,090 A * 6/1987 Crosslen
4,976,359 A * 12/1990 Hardy ..... 211/163 X
5,346,079 A * 9/1994 Price et al. ..... 211/131.1
5,564,578 A * 10/1996 Smith ..... 211/133.1
6,189,710 B1 * 2/2001 Mason ..... 211/131.1

* cited by examiner

*Primary Examiner*—Robert W. Gibson, Jr.
(74) *Attorney, Agent, or Firm*—Collard & Roe, P.C.

(57) ABSTRACT

A display device for displaying articles of merchandise, such as books and posters, is provided. The display device has four rectangular support structures. Each support structures includes a base, a first side wall, a second side wall, a first door hinged to the first side wall, a second door hinged to the second side wall, a back wall, and a cover hinged to the back wall. Each side wall is hinged to a side wall of an adjoining one of the support structures. At least one wheel is connected to the base of each support structure. The display device is movable between an open position wherein the back walls of the support structures define an enclosed space and a closed position wherein the back walls of each support structure faces the back wall of an adjoining one of the support structures.

10 Claims, 11 Drawing Sheets

Fig. 4A
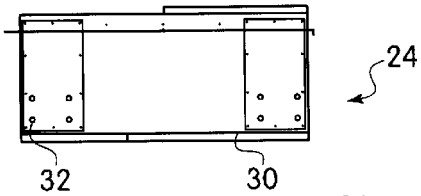
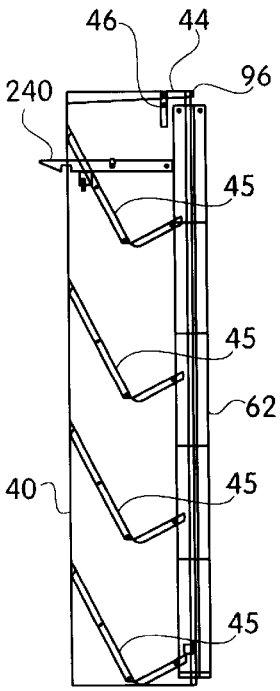
Fig. 4B
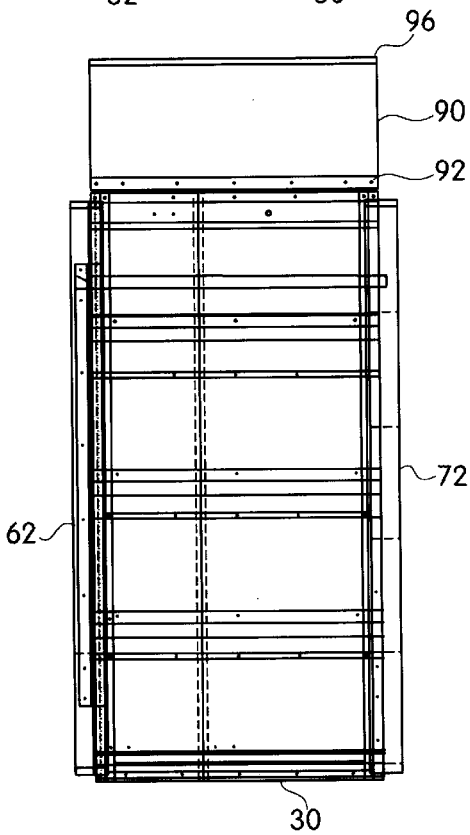
Fig. 4C
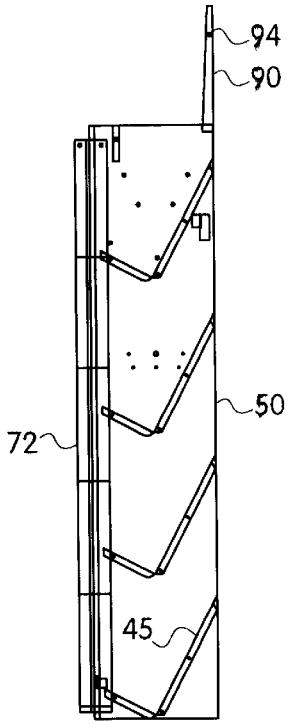
Fig. 4D

Fig. 5A
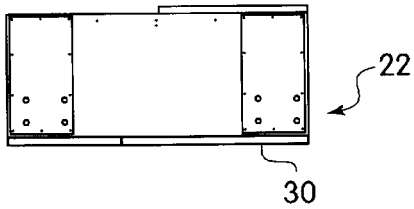
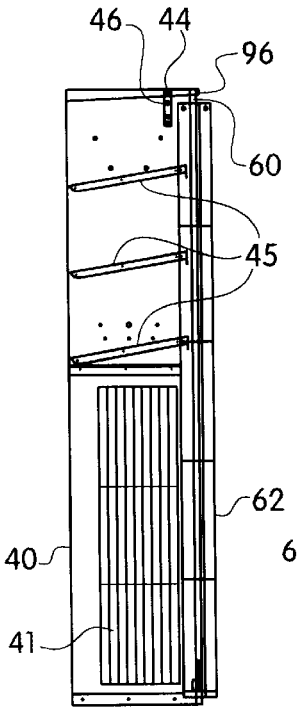
Fig. 5B
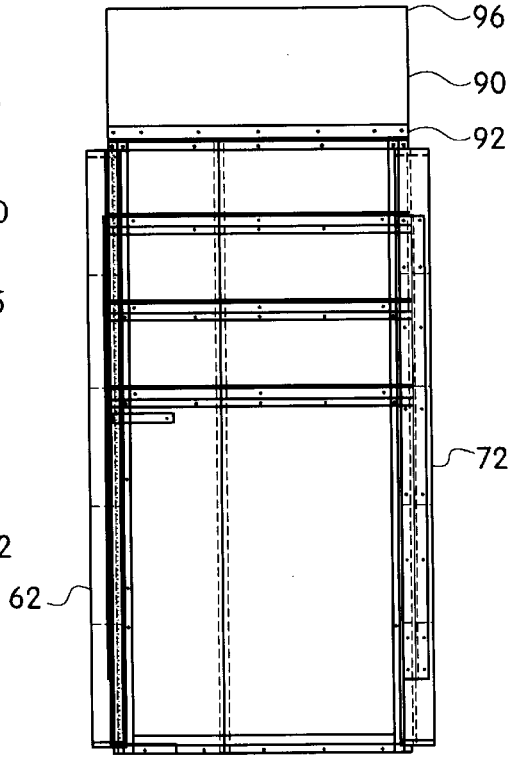
Fig. 5C
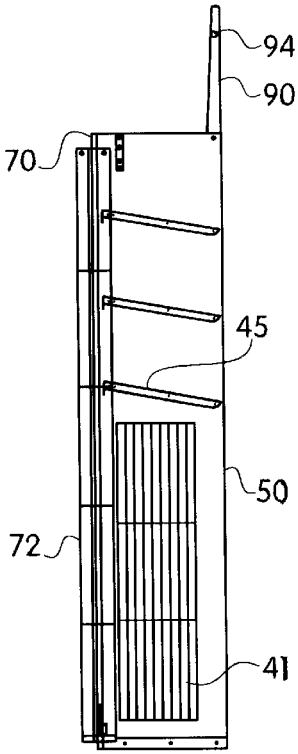
Fig. 5D

Fig. 7A
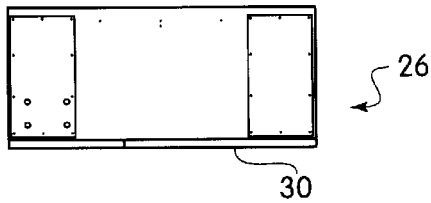
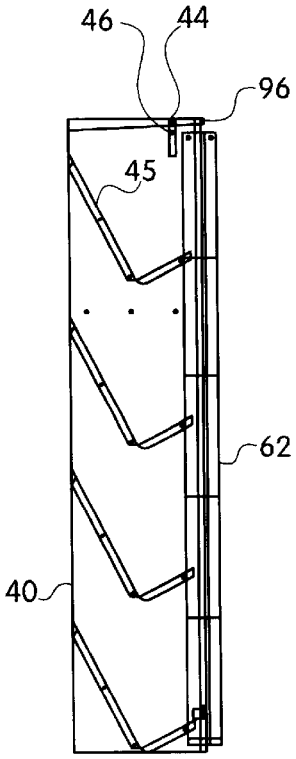
Fig. 7B
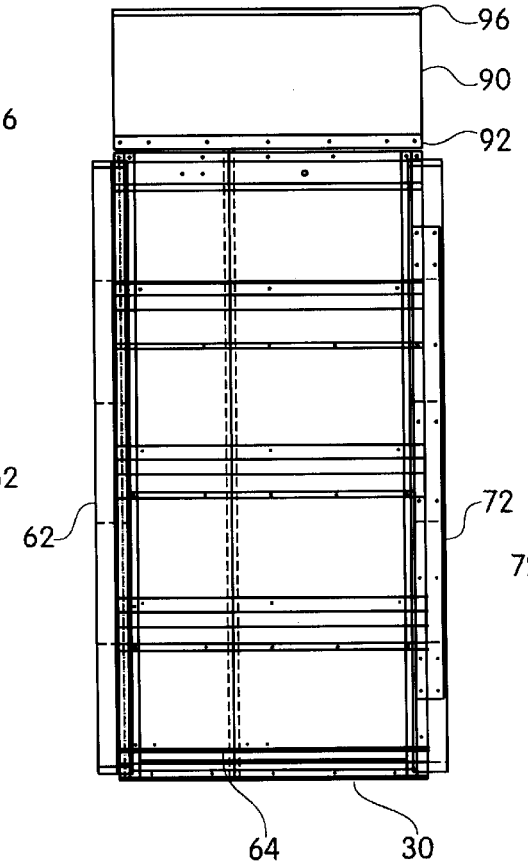
Fig. 7C
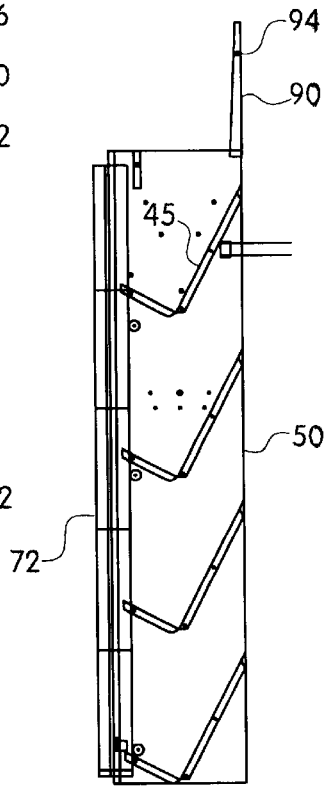
Fig. 7D

DISPLAY DEVICE

BACKGROUND OF THE INVENTION

1. Field of the Invention

The present invention relates to display devices and more particularly to an itinerant rolling kiosk type display case movable from one presentation location to another presentation location and suitable for placement, for example, in the center or other interior area of a room for displaying articles of merchandise such as books and posters.

2. The Prior Art

At the present time there are a large variety of commercially available display devices. One such known device is formed from two rectangular open faced support structures in which articles of merchandise may be displayed.

The support structures are joined by a central hinge that permits the support structures to pivot between a closed position and an open position. In the closed position, the open face of the support structures face each other, closing off the merchandise in each structure from the outside. In the open position, the support structures form a "V" shape which permits access to the merchandise in each structure. Wheels underneath the support structures allow the display to be transported to a location where the support structures may be opened to permit display of merchandise.

One disadvantage of this known device is that merchandise can be displayed on only one side of the device. Thus, this device is generally placed along the perimeter or in a corner of a room. Tables are typically used to display merchandise in the interior of the room, but hold limited merchandise and do not allow for good presentation of the merchandise.

Another disadvantage is that the device may become unstable and tip backwards if the case is opened too far. Although bumpers may be provided in an effort to prevent excess opening, if the bumpers come off, the device becomes potentially unstable with a risk of tipping.

Hence, there is still a need for a display device which is easily transported and placed in position and which provides a simple and safe way to present articles of merchandise, such as books and posters, on more than one side of the device, and which is stable in any configuration.

SUMMARY OF THE INVENTION

A display device is provided for displaying articles of merchandise, for example, books and posters. The device has four rectangular support structures. Each support structure includes a base, a first side wall, a second side wall, a first door hinged to the first side wall, a second door hinged to the second side wall, a back wall, and a cover hinged to the back wall. Each side wall is hinged to a side wall of an adjoining one of the support structures. At least one wheel is connected to the base of each support structure. The structure is movable between an open position wherein the back walls of the support structures define an enclosed space and a closed position wherein the back wall of each support structure faces the back wall of an adjoining one of the support structures.

Preferably, the support structures are made of aluminum and may include at least one shelf for displaying an article of merchandise. For example, a support structure may include at least three shelves for display of books and a plurality of hinged cases for display of posters. One of the support structures preferably has a latch movable between a raised position and a lowered position. In the lowered position, the latch is adapted to secure the display device in the closed position. In the raised position, the latch permits the display device to be movable to the open position.

A movable detent may be disposed in the first side wall of each support structure which is aligned with an opening disposed in the cover of that support structure. Preferably, a lip is formed in the cover of each support structure which is adapted to be disposed over the doors of that support structure. The opening is adapted to receive the detent to secure the cover in a lowered position in which the lip is disposed over the doors of that support structure. Upon removal of the detent from the opening, the cover is able to be placed in a raised position permitting the doors of the support structure to be opened.

Preferably, the device has no more than a total of six wheels connected to the bases of the support structure. A least one bumper may be disposed on an outer surface of one of the side walls of each support structure. Advertising is preferably printed on an inner surface of one of the doors and of the cover of each support structure.

BRIEF DESCRIPTION OF THE DRAWINGS

Other objects and features of the present invention will become apparent from the following detailed description considered in conjunction with the accompanying drawings .It should be understood, however, that the drawings are designed for the purpose of illustration only and not as a definition of the limits of the invention.

In the drawings, wherein similar reference characters denote similar elements throughout the several views:

FIGS. 4A–4D are bottom, left, front and right side views, respectively, of a first embodiment of a support structure incorporated in the display device of the present invention;

FIGS. 5A–5D are bottom, left, front and right side views, respectively, of a second embodiment of a support structure incorporated in the display device of the present invention;

FIGS. 7A–7D are bottom, left, front and right side views, respectively, of a fourth embodiment of a support structure incorporated in the display device of the present invention;

DETAILED DESCRIPTION OF PREFERRED EMBODIMENTS

Figure 1:
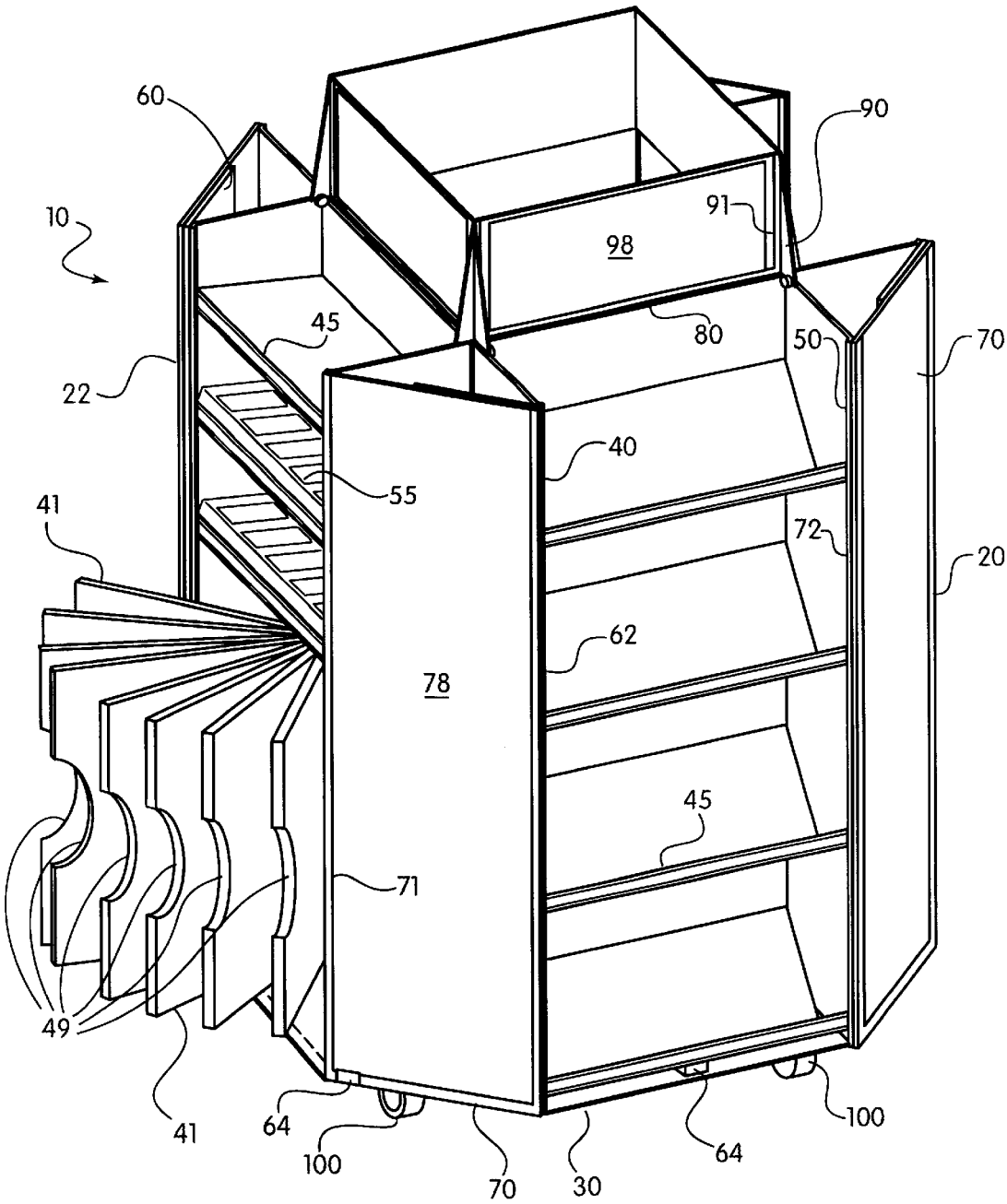
FIG. 1 is a front perspective view of an embodiment of the present invention in the open position with the doors open and the covers raised.
Figure 2:
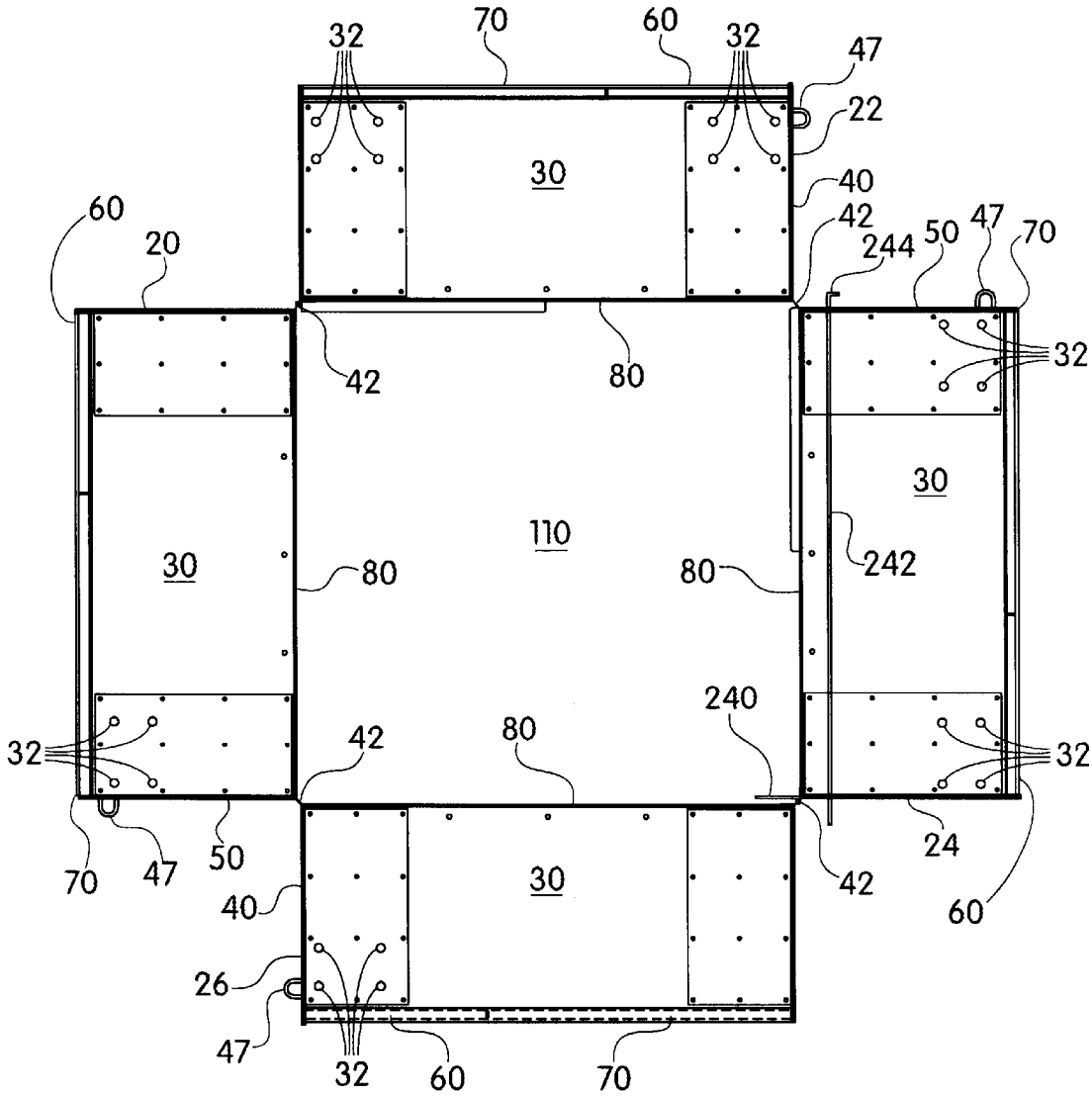
FIG. 2 is a bottom view of the embodiment of FIG. 1 in the open position with the doors closed.
Figure 3:
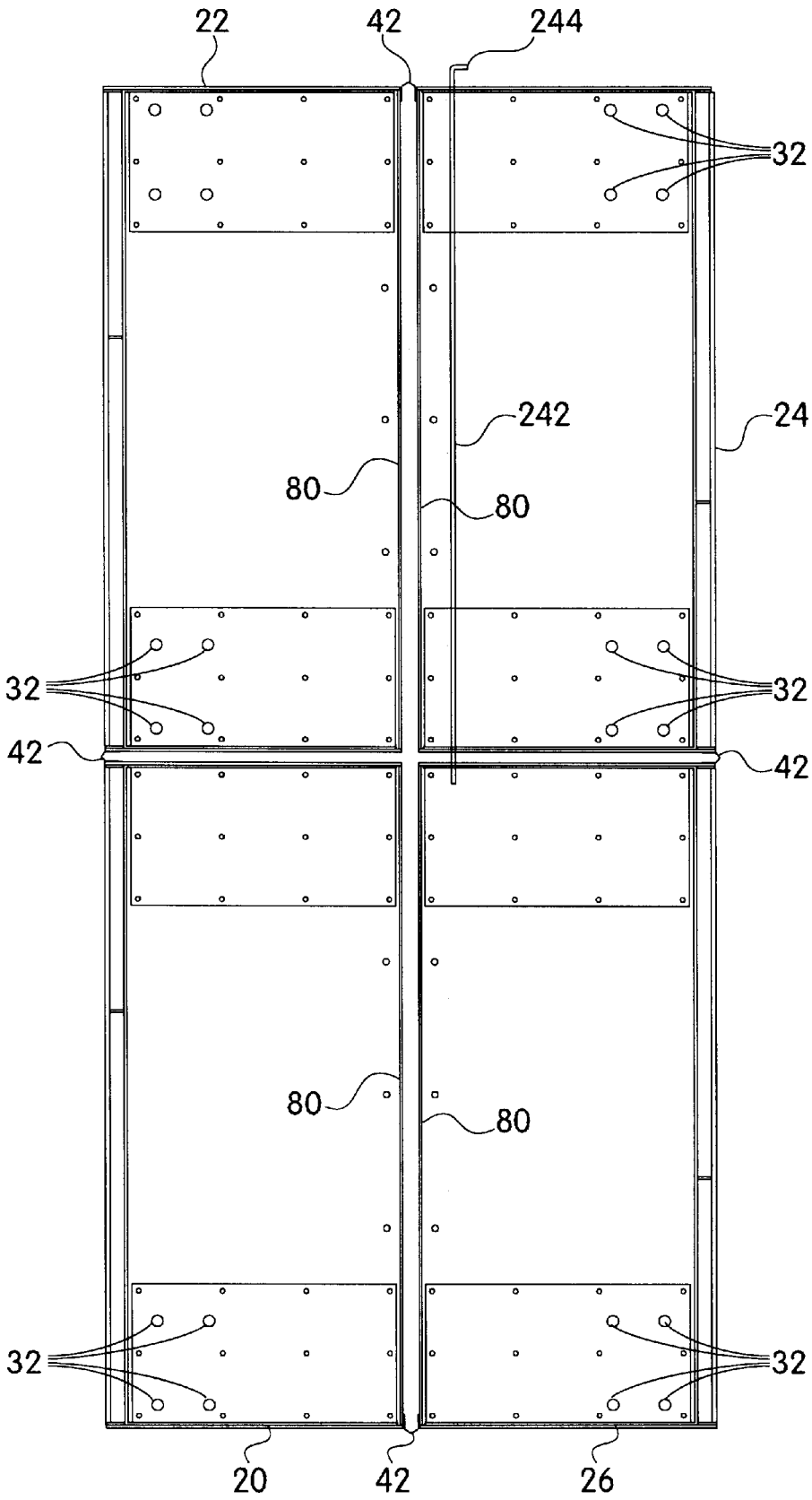
FIG. 3 is a bottom view of the embodiment of FIG. 1 in the closed position.
Figures 6A, 6B, 6C, 6D:
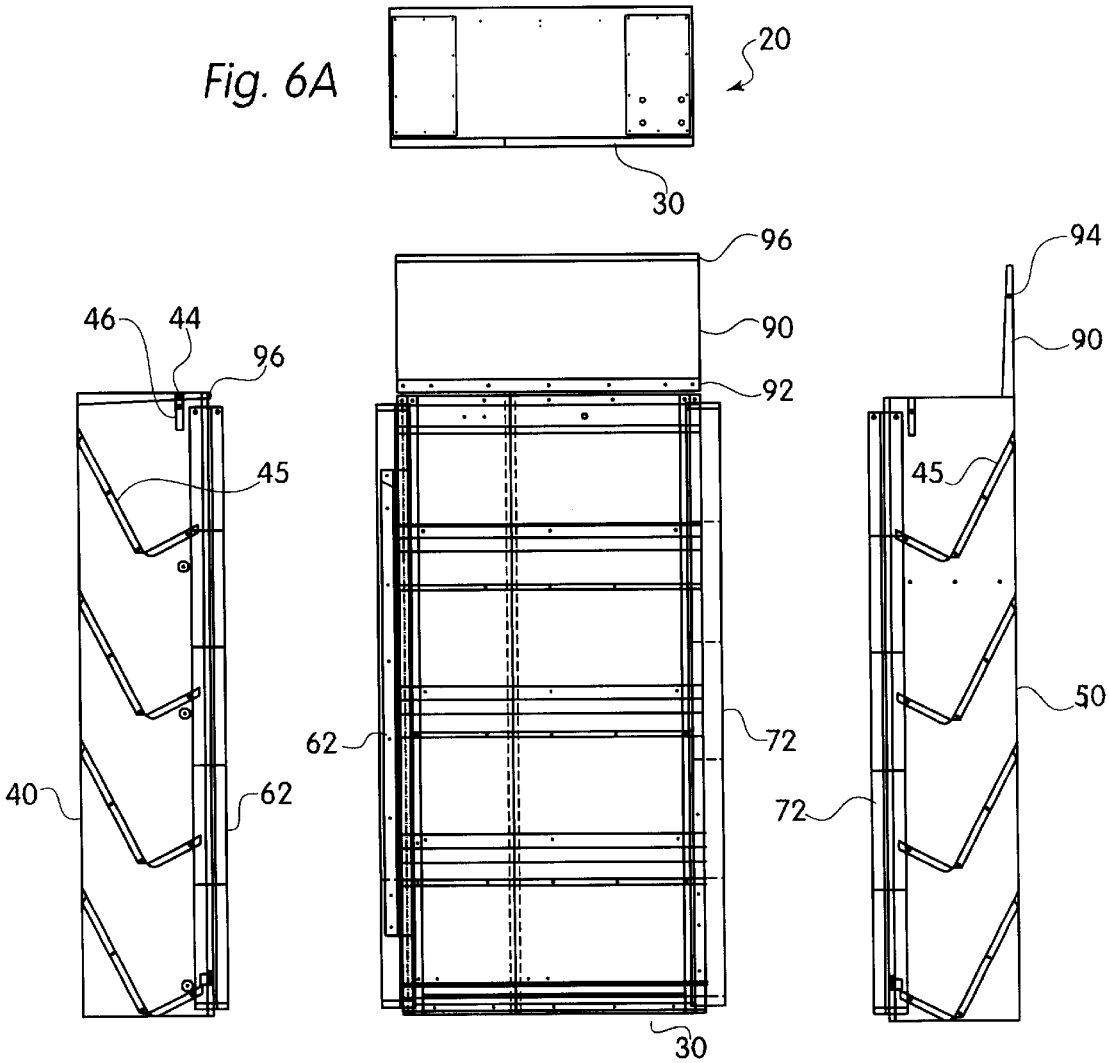
FIGS. 6A–6D are bottom, left, front and right side views, respectively, of a third embodiment of a support structure incorporated in the display device of the present invention.

Turning now in detail to the drawings, FIG. 1 shows an embodiment of display device 10 in the open position. Device 10 includes at least four rectangular support structures or carts 20, 22, 24, 26 shown in FIG. 2. Each support structure includes a base 30, a first side wall 40, a second side wall 50, a first door 60 hinged at 62 to first sidewall 40, a second door 70 hinged at 72 to second side wall 50, a back wall 80, and a cover or top 90 hinged at 92 to back wall 80. Each side wall 40 is hinged at 42 to an adjoining support structure. As shown in FIGS. 2–3, support structure 20 is hinged to support structures 22 and 26; support structure 22 is hinged to support structures 24 and 20; support structure 24 is hinged to support structure 26 and 22; and support structure 26 is hinged to support structures 20 and 24.

Each support structure is preferably a modular unit which can be adapted to have a plurality of angled or flat shelves and additional devices such as poster units so that the display device has the ability to be set up with a plurality of different interior configurations depending on the merchandise to be displayed.

Preferably, each support structure has at least one shelf 45 for displaying an article of merchandise such as book 55. For example, support structure 20 shown in FIG. 1 has four shelves 45 suitable for displaying books. Support structure 22 has three shelves 45 and a plurality of hinged cases 41 supported in retainer 43 for display of posters. Cases 41 are transparent and have scalloping or cutaway portions 49 for ease of pivoting each case 41 about retainer 43. Shelves 45 may be L-shaped as shown in support structure 20 or may be flat as shown in support structure 22 in FIG. 1. Each support structure may be used to display different items of merchandise. For example, support structures 20 and 24 may be used primarily to display books, support structure 22 may be used to display books and posters, and support structure 26 may be used to display clearance items.

At least one wheel 100 is connected to the base 30 of each support structure. Openings 32 shown in FIGS. 2–3 may be provided in base 30 for receipt of screws, self-clinching nuts, or other fasteners to attach each wheel 100 to base 30. Preferably, no more than a total of six wheels are connected to the bases of the support structures. For example, as shown in FIGS. 2–3, each of support structures 20 and 26 has a set of four openings 32 for attachment of one wheel. Each of support structures 22 and 24 has two sets of openings 32 for attachment of two wheels.

Display device 10 is movable between an open position shown in FIGS. 1 and 2 and a closed position shown in FIG. 3. In the open position, the back walls 80 of support structures 20, 22, 24, 26 define an enclosed space 110. Preferably, enclosed space 110 is a square or a rectangle. For example, space 110 may be approximately 22 by 24 inches. In the closed position, the back wall 80 of each support structure 20, 22, 24, 26 faces the back wall of an adjoining support structure. For example, as shown in FIG. 3, the back wall of support structure 20 faces the back wall of support structure 26. The back wall of support structure 22 faces the back wall of support structure 24.

Two of the support structures, for example, support structures 22 and 26 are preferably provided with a fastener on one side wall, such as side walls 50, for attaching a lanyard or cable 52. Lanyard 52 preferably has loops 54 on each end to facilitate fastening to the support structure. Lanyard 52 helps prevent display device 10 from being opened too far so that the hinges between the support structure are not subjected to undue strain.

Figure 10:
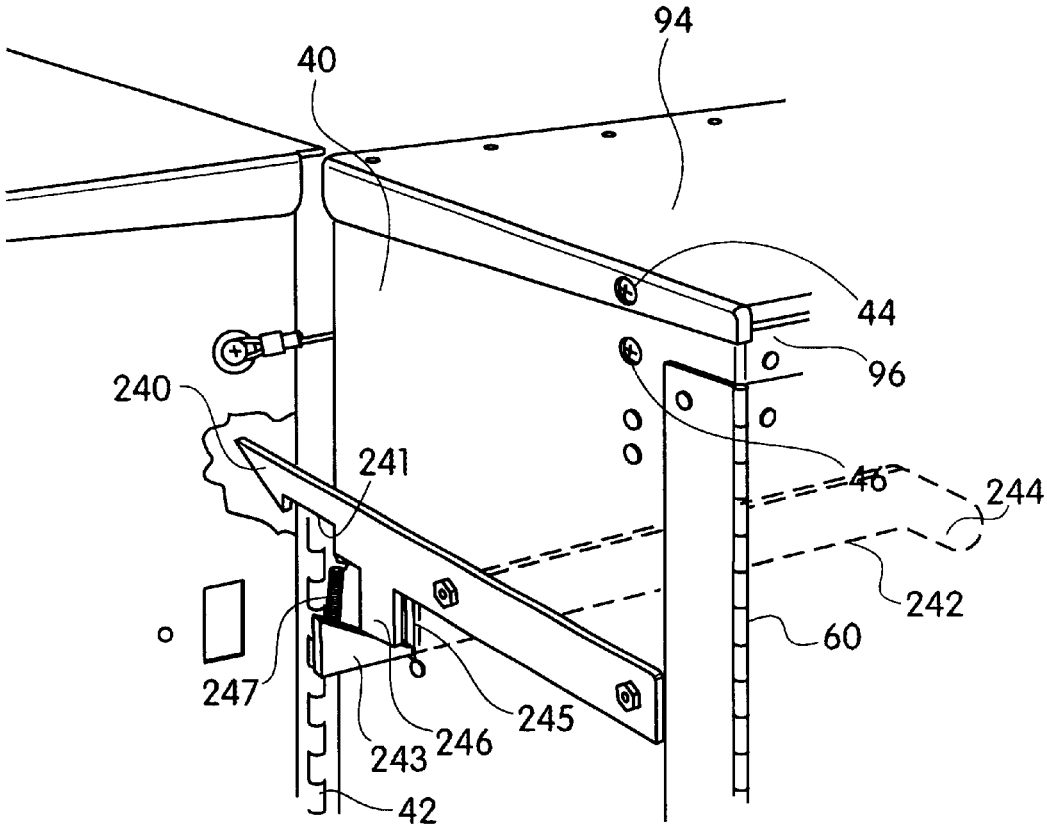
FIG. 10 is a perspective view of a portion of the support structures of FIGS. 4B and 7D showing a movable detent and opening, the rod actuator extending through the support structure of FIG. 4B in phantom view, and a portion of the support structure of FIG. 7D broken away to show the latch.
Figure 11A:
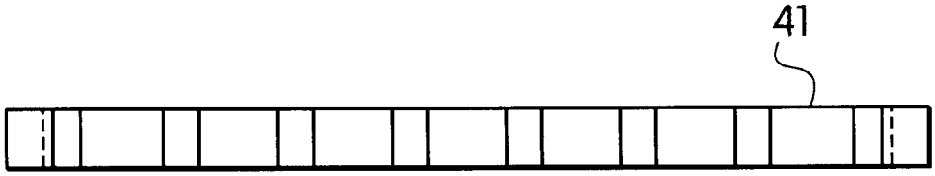
FIGS. 11A and 11B are side views of a poster case and retainer, respectively, incorporated into the embodiment of FIGS. 5A–5D.
Figure 11B:
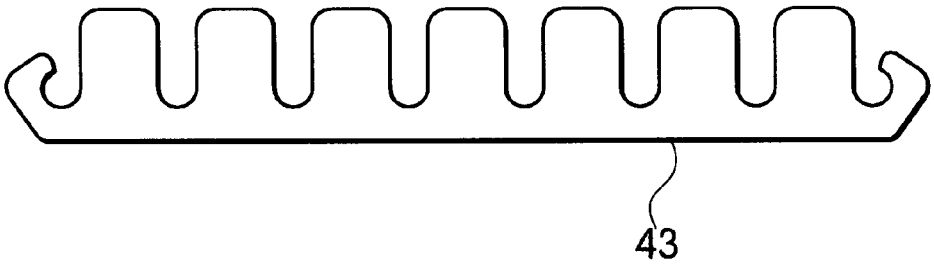
Figure 12:
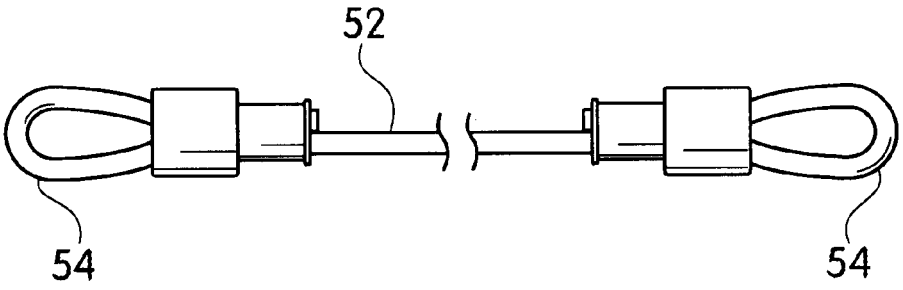
FIG. 12 is a partial side view of a cable-flexible restraint lanyard for use in the display device of the present invention.

As shown in FIGS. 4B and 10, support structure 24 is provided with a latch 240. When latch 240 is in a lowered position, display device 10 is secured in the closed position. In a raised position, latch 240 permits display device 10 to be movable to the open position. Latch 240 cooperates with a rod actuator 242 to lock and unlock hinge 42 between support structure 24 and 26, thereby preventing unintentional movement of display device 10 to the open position. Pulling out of handle 244 of actuator 242 raises latch 240 to release hinge 42 connecting support structures 24 and 26.

FIG. 10 shows latch 240 in the lowered locking position where a cut-away 241 rests on top of hinge 42 and the end of latch 240 prevents movement of support structures 24 and 26. Rod actuator 242 has an inclined wedge 243 so that when rod actuator 242 is moved toward the right in opening 245 in the right unit of FIG. 10, the inclined edge of wedge 243 cooperates with a lower member 246 of latch 240 resting on wedge 243 to raise latch 240 to release locking of hinge 42. A spring 247 connected to latch 240 assists in returning latch 240 to the lowered position when rod actuator 242 moves wedge 243 toward the left in FIG. 10.

As shown in FIG. 10, a movable detent 44 actuated by button 46 in cooperation with a flat spring (not shown) is disposed in first side wall 40 of support structure 24. Similar detents 44 and buttons 46 with cooperating springs are disposed in first side walls 40 of support structures 20, 22 and 26. Each cover 90 likewise has an opening 94 aligned with movable detent 44. Each cover 90 has a lip 96 formed therein, which is adapted to be disposed over doors 60, 70 of that support structure. Upon removal of detent 44 from opening 94, cover 90 is able to be placed in a raised position permitting doors 60, 70 of the support structure to be opened as shown in FIG. 1.

A torsion spring (not shown) may be provided on each side of hinge 92 so that cover 90, once raised, will remain in the raised position to prevent the cover from closing abruptly on a user's hands or fingers.

Figure 8A:
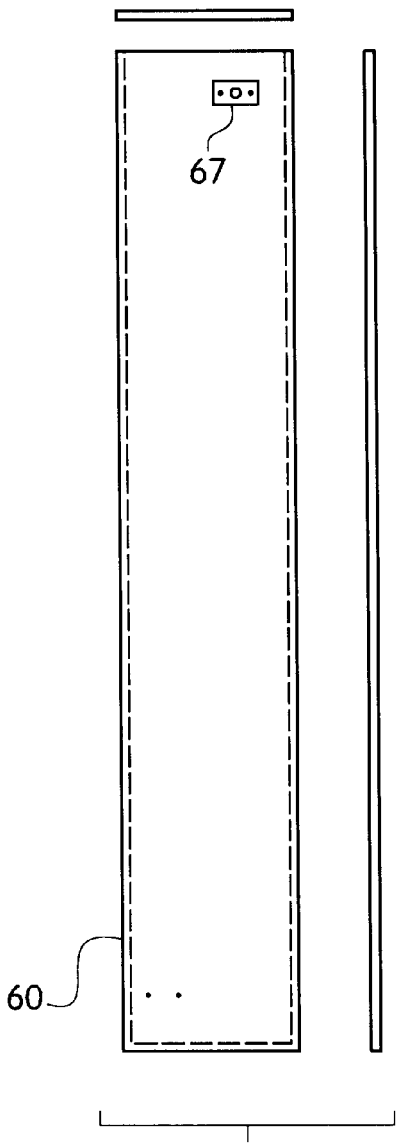
FIGS. 8A and 8B are front views of first and second doors, respectively, for the support structure shown in FIGS. 4A–4D, 6A–6D and 7A–7D.
Figure 8B:
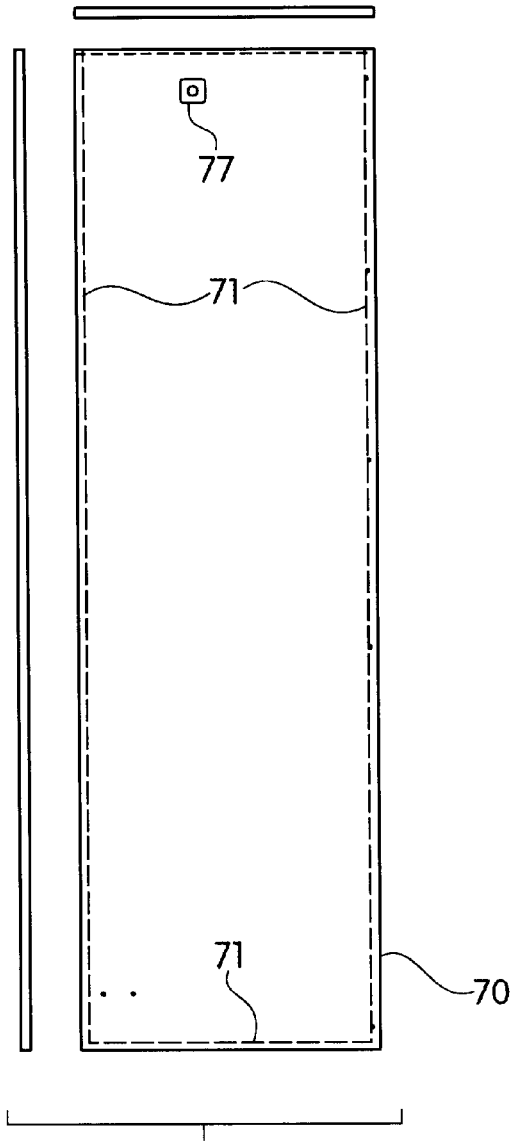

Doors 60, 70 are designed to swing open on hinges 62, 72 at least 275° so as to fit in front of or behind a door of an adjoining support structure. For example, doors 70 may be made wider than doors 60 of each support structure so that in the open position, door 70 of support structure 20 will be disposed in front of door 60 of support structure 26; door 70 of support structure 22 will be disposed in front of door 60 of support structure 20; door 70 of support structure 24 will be disposed over door 60 of support structure 22; and door 70 of support structure 26 will be disposed over door 60 of support structure 24. Doors 60, 70 of each structure may be designed to snap into place when in the open position with door 70 in front of door 60, thereby providing further structural stability to the device. For example, as shown in FIG. 8A, 8B, door 60 may be provided with a male coupling 67 and door 70 may be provided with a female coupling 77 to secure door 60 of one support structure to door 70 of an adjacent support structure in the open position.

A door latch such as magnetic latches 64 may be provided in base 30 of each support structure 20, 22, 24, 26, such as is shown for cart 20 in FIG. 1, to secure doors 60, 70 in a closed position. Preferably, a magnetic latch 64 is also provided on each of doors 60, 70 as well which cooperates with latches 64 on base 30. Alternatively, a rotatable door latch may be provided in one of the doors, such as door 60, of each support structure. For example, the latch may be disposed toward the bottom of the doors and may be unlatched by turning a knob (not shown) or other suitable mechanism disposed on the outside of door 60.

At least one bumper 47 may be disposed on an outer surface of one of the side walls of one or more of the support structures. Preferably, at least one bumper 47 is disposed on a sidewall of each support. For example, as shown in FIG. 2, bumpers 47 are disposed on side walls 40 of support structures 22 and 26 and on side walls 50 of support structures 20 and 24. Bumpers 47 protect the edges of display device 10 during transport in the closed position.

Figure 8C:
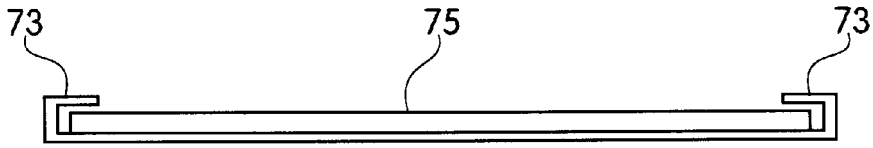
FIG. 8C is a top view of second door of FIG. 8B.
Figure 9:
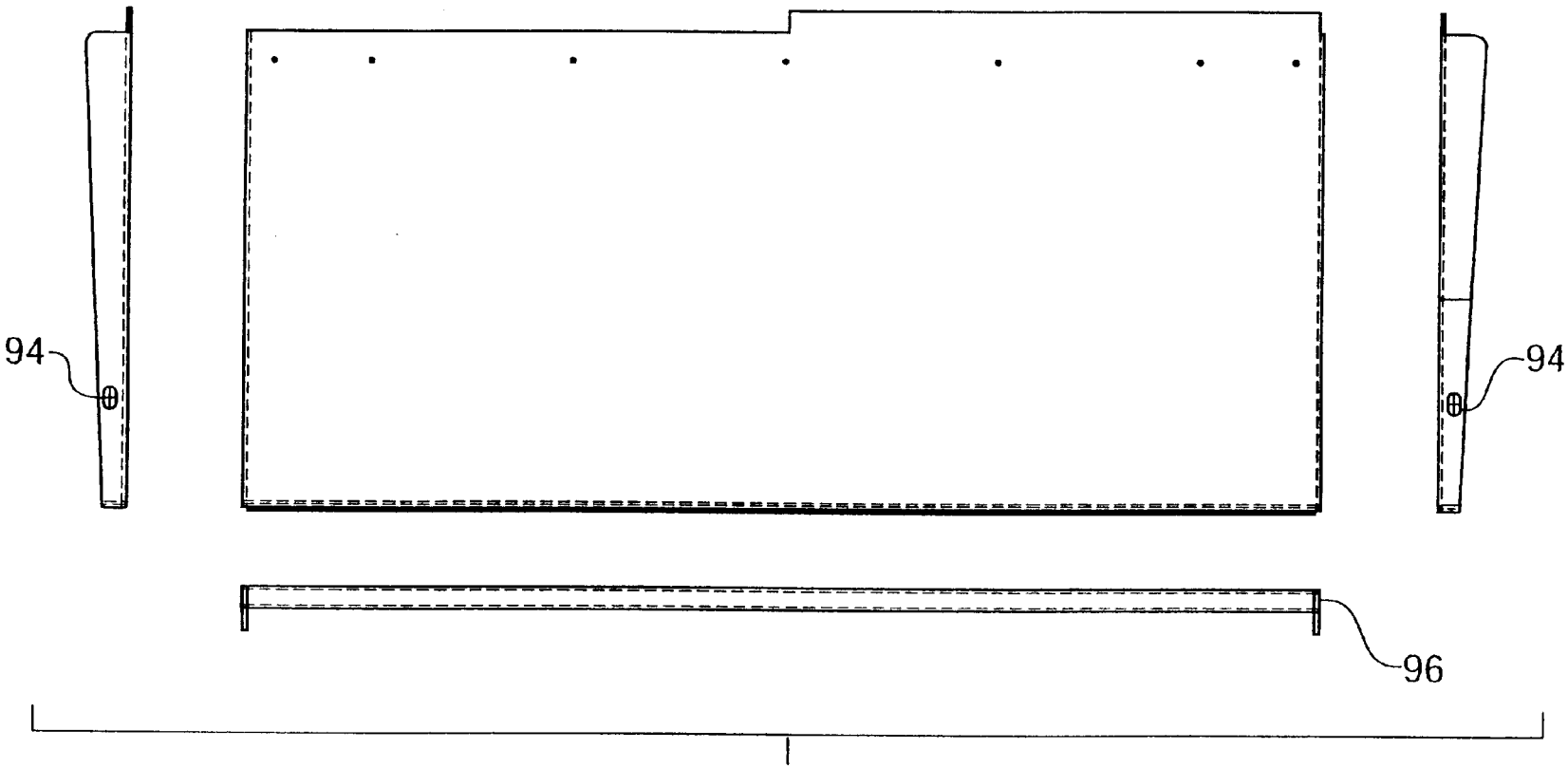
FIG. 9 is a plan view of a cover for the support structure incorporated in the display device of the present invention.

Advertising may be provided on the display device. For example, door 70 and cover 90 may be provided with respective channels or card/graphic slots 71, 91 for receipt of advertising on their inner surfaces. As shown in FIG. 8C, channel 71 is formed by a flange or folding 73 along the two long sides and bottom of door 70 to form a Unshaped channel. The top of the door has a short straight bend. In this way, an advertising card or other graphic material 75 may be slid into door 70 from the top. A similar flange or folding is used to form channel 91 in cover 90. As shown in FIG. 1, advertising may be provided on surface 78 of door 70 of support structure 22 and on surface 98 of cover 90 of support structure 20. Because door 70 of support structure 22 covers door 60 of support structure 20 when the doors are opened, the inner surface of door 60 of support structure need not have any advertising, and folding may be provided on all four sides. Advertising may also be printed directly on the inner surface of the doors and cover of each support structure.

Preferably, support structures 20, 22, 24 and 26 are made of aluminum. For example, the left and right side of each support structure may be made from 0.070 inch thick aluminum on one side. Cover 90 may be made from 0.030 inch thick aluminum. Doors 60, 70 may be made from 0.040 inch thick aluminum. Shelves 45 may be made from 0.030 inch thick aluminum, preferably prefinished white on one side. Hinges 42, 62, 72 and 92 may be made of zinc plated steel of suitable thickness, for example 0.042 inches. Retainer 43 and cases 41 may be made from plastic. Lanyard 52 may be made of a flexible vinyl coated steel cable.

Display device 10 preferably is transported in the closed position and brought to a desired location for display of merchandise, preferably away from the walls of a room. Handle 244 is gripped and pulled out to release latch 240. The display device is then pulled open to form a square or rectangle defining interior space 110 as shown in FIG. 2. Side buttons 46 are pushed in and cover 90 of each support structure is raised.

Doors 60, 70 are then moved away from the magnetic latches on base 30 of each support structure and then folded back and snapped together one on top of the other to form graphic side panels with advertising or other materials depicted thereon.

To close display device 10, all four side panels formed by doors 60, 70 of each support structure are unsnapped and each door closed in front of its support structure. Care should be taken to make sure the doors are shut with the covers in the raised position. Covers 90 are then closed for the four support structures, and the doors of each support structure locked by latches 64. Display device 10 is then pushed together until latch 240 catches hinge 42. The device is then ready for transport.

While several embodiments of the present invention have been shown and described, it is to be understood that many changes and modifications may be made thereunto without departing from the spirit and scope of the invention as defined in the appended claims.

What is claimed is:

1. A display device for displaying an article of merchandise comprising:

(a) four rectangular support structures, each of said support structures comprising a base, a first side wall, a second side wall, a first door hinged to said first side wall, a second door hinged to said second side wall, a back wall, and a cover hinged to said back wall, each side wall being hinged to a side wall of an adjoining one of said support structures; and (b) at least one wheel connected to the base of each of said support structures;

wherein said display device is movable between an open position wherein the back walls of said support structures define an enclosed space and a closed position wherein the back wall of each support structure faces the back wall of an adjoining one of said support structures.

2. The display device according to claim 1 wherein said support structures are made of aluminum.

3. The display device according to claim 1 wherein one of said support structures comprises a latch movable between a raised and a lowered position, said latch in the lowered position being adapted to secure the display device in the closed position and in the raised position permitting the display device to be movable to the open position.

4. The display device according to claim 1 wherein each of said support structures comprises at least one shelf for displaying an article of merchandise.

5. The display device according to claim 1 further comprising:

(a) a movable detent disposed in the first side wall of each support structure;

(b) an opening disposed in the cover of each support structure and aligned with the movable detent of that support structure; and (c) a lip formed in the cover of each support structure and adapted to be disposed over the doors of that support structure;

wherein said opening is adapted to receive said detent to secure the cover in a lowered position in which the lip is disposed over the doors of said support structure and wherein upon removal of said detent from said opening the cover is able to be placed in a raised position permitting the doors of said support structure to be opened.

6. The display device according to claim 1 wherein the device has no more than a total of six wheels connected to the bases of said support structures.

7. The display device according to claim 1 further comprising at least one bumper disposed on an outer surface of one of said side walls of each support structure.

8. The display device according to claim 1 wherein advertising is printed on an inner surface of one of said doors and on an inner surface of said cover of each support structure.

9. The display device according to claim 1 wherein at least one of said support structures comprises at least three shelves for display of books.

10. The display device according to claim 1 wherein at least one of said support structures comprises a plurality of hinged cases for display of posters.

* * * * *